US007287748B2

(12) United States Patent
Maeder et al.

(10) Patent No.: US 7,287,748 B2
(45) Date of Patent: Oct. 30, 2007

(54) METHOD AND APPARATUS FOR PRODUCING SELECTIVELY COLLATED PRINT PRODUCTS

(75) Inventors: Rémy Maeder, Rheinfelden (CH); Peter Lehmann, Oftringen (CH)

(73) Assignee: Müller Martini Holding AG, Hergiswil (CH)

( * ) Notice: Subject to any disclaimer, the term of this patent is extended or adjusted under 35 U.S.C. 154(b) by 147 days.

(21) Appl. No.: 10/963,786

(22) Filed: Oct. 14, 2004

(65) Prior Publication Data

US 2005/0085943 A1 Apr. 21, 2005

(30) Foreign Application Priority Data

Oct. 16, 2003 (EP) ..... 03405744

(51) Int. Cl.
*B65H 39/00* (2006.01)
*B65H 33/14* (2006.01)

(52) U.S. Cl. ..... 270/52.05; 270/52.04; 270/52.2; 270/52.21; 270/52.22; 270/52.19; 270/58.29; 270/58.02; 270/58.03; 700/220

(58) Field of Classification Search ..... 270/52.04, 270/52.05, 52.2, 52.21, 52.22, 52.19, 58.29, 270/58.02, 58.03; 700/220
See application file for complete search history.

(56) References Cited

U.S. PATENT DOCUMENTS 3,606,728 A * 9/1971 Sather et al. ..... 53/54
4,022,455 A 5/1977 Newsome et al.
4,499,834 A * 2/1985 Ruetschle et al. ..... 112/2
4,936,562 A * 6/1990 Rowe ..... 270/56
5,189,863 A * 3/1993 Pozzi ..... 53/411
5,316,281 A 5/1994 Bale et al.
5,522,587 A * 6/1996 Banks et al. ..... 270/58.03
5,826,869 A * 10/1998 Nyffenegger et al. .... 270/52.02

FOREIGN PATENT DOCUMENTS

DE 38 32 155 A1 7/1989
DE 198 11 635 A1 9/1999
WO WO98/03347 A1 1/1998

* cited by examiner

*Primary Examiner*—Gene O. Crawford
*Assistant Examiner*—Leslie A Nicholson, III
(74) *Attorney, Agent, or Firm*—Venable LLP; Robert Kinberg; Ryan M. Flandro

(57) ABSTRACT

A method and apparatus for producing selectively collated print products employ a production section, a control device, a transfer-out device for transferring out defective print products, a detection device that detects and records gaps resulting from the transfer out of defective print products, and a transfer-in device. Initially, a line of print products are processed in a production section; a predetermined number of print products are diverted from the production section and supplied to a product buffer. If the print products are not diverted, the line of print products continue in a conveying section and gaps between the print products are detected and recorded via the detection device. A number of print products are removed from the product buffer based on a control signal from the control device to fill detected gaps between print products in the conveying section; and the removed print products are inserted into the recorded gaps.

17 Claims, 1 Drawing Sheet

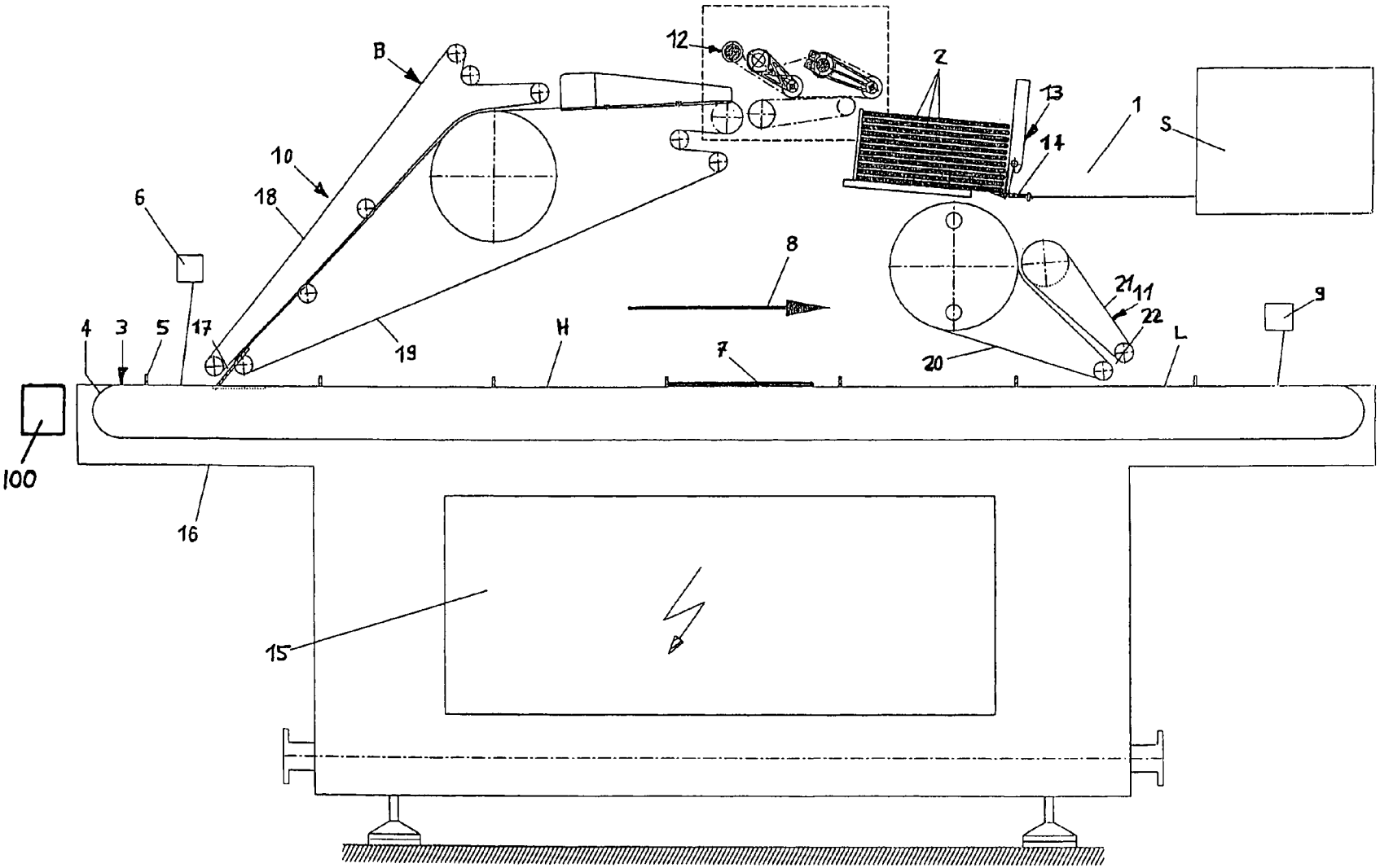
S
1
9
L
21
11
22
13
14
2
20
8
7
12
H
B
19
10
18
17
6
5
3
4
100
16
15

METHOD AND APPARATUS FOR PRODUCING SELECTIVELY COLLATED PRINT PRODUCTS

CROSS-REFERENCE TO RELATED APPLICATION

This application claims the priority of European Patent Application No. 03405744.8, filed on Oct. 16, 2003, the subject matter of which is incorporated herein by reference.

BACKGROUND OF THE INVENTION

The invention relates to a method for producing selectively collated print products, for example newspapers or magazines, using a production section, for example a gathering and wire-stitching machine or a perfect binder, a control device, a transfer-out device for transferring out defective print products, as well as means for detecting the gaps created by transferring out print products.

The selective production of print products, also referred to as "selective binding," is known wherein different editions of a print product, such as a catalogue, are produced during the same production run. For example, one catalogue may be more voluminous than another catalogue or the one catalogue may contain different order form inserts. "Selective binding" makes it possible to produce different products during the same production run that meet the specific requirements of the addressees.

However, breakdowns in production or other malfunctions, which necessitate the transfer out of damaged or defective print products, are a problem since transferred-out products must be replaced. Since several comparatively complex operations are required for producing print products, such malfunctions are unavoidable in practical operations with high production outputs. For example, the several complex operations may include the cutting to size of a print product in a cutting machine; the collating, wire-stitching, perfect binding, or thread stitching; affixing of address labels; stacking; and the turning of print products. If products must be transferred-out during the so-called "selective binding" process, known methods lead to an extremely involved and manual operation for the most part, which considerably adds to the production costs. The following methods for closing the above-defined gaps are known from prior art.

With the so-called "reorder/remake" technique, products that are transferred-out as a result of a production malfunction are re-produced and subsequently added manually to the individual packages to be mailed. However, this operation is comparatively expensive and involved since the subsequently produced products must be inserted manually into the correct stack and/or into the correct package.

SUMMARY OF THE INVENTION

It is an object of the present invention to create a method and an apparatus of the aforementioned type which avoids the above-described difficulties.

In a method for producing selectively collated print products with the use of a production section, a control device, a transfer-out device for transferring out defective print products from the production section, and a detection device that detects and records gaps resulting from the transfer out of defective print products, this object may be achieved by processing a line of print products in a processing production section; transferring out a predetermined number of print products from the processing production section; supplying the predetermined number of transferred-out print products to a product buffer; continuing conveying of the line of print products that bypass the diverting step and continue in a conveying production section; detecting and recording a gap between print products continuing in the conveying production section; removing a number of transferred-out print products from the product buffer based on a control signal from the control device to fill the gaps detected and recorded by the detection device between the print products; and inserting the removed print products into the recorded gaps between conveyed print products.

With the method according to an embodiment of the invention, a predetermined number of so-called generic print products, also referred to as "generic books," are produced in the production section, these generic print products are then diverted from the production section and supplied to a product buffer. During the continuing conveying of print products that bypass the diverting to the product buffer, if a gap is created by a defective product or products being transferred out, this gap is recorded and the number of generic print products needed to fill the recorded gap may be removed from the product buffer. These removed print products are then inserted into the recorded gap and thus are introduced into the production section of continued conveyed print products. Consequently, this method permits a fully automatic refilling of gaps. Since gaps between printed products in the production section are filled directly and automatically according to an embodiment of the invention, a high degree of effectiveness is reached and no allocation of manual power is required.

According to one modification of the invention, a particularly high output along with high operational safety may be ensured if the print products for filling a gap are automatically guided from the product buffer via a transfer-in section onto a timed production line where they are inserted in place of the missing products in order to close the gap.

According to a different modification of the invention, a particularly high feed-in may be ensured if the gaps are essentially filled in at the end of the production section.

The method according to an embodiment of the invention thus permits a fully automatic filling of gaps created by print products being transferred out due to damaged or defective print products during the "selective binding" process. Consequently, the method according to this embodiment of the invention results in a reduction in shipping costs due to route-correct sorted packages with a simultaneously high degree of effectiveness and a high feed-in guarantee. As a result, operations resulting from the manual allocation of subsequently produced print products and a reduction in the total output can be avoided.

An apparatus for achieving the above method includes a production section conveying print products in a processing direction; a transfer-out device for transferring out defective or damaged print products from the production section; a detection device that detects and records gaps in a production line that results from the transfer-out of print products in the production section; a control device associated with the detection device; a transfer-out diverter capable of moving between a diverting position and an inactive position where the diverting position causes print products moving in the processing direction to be transferred out to a secondary conveying line; a product buffer disposed downstream of the transfer-out diverter in the secondary conveying line, the product buffer to receive print products from the transfer-out diverter and to store the same until signals from the control device indicate that a stored print product be removed; and a transfer-in device disposed downstream of the product buffer to receive removed print products from the product buffer and to supply the removed print products to the production section.

According to one modification of the invention, the transfer-in device is arranged such that the print products removed from the product buffer are essentially fed in at the end of the production section.

The apparatus according to an embodiment of the invention can be achieve at a comparatively low cost by using devices which are known per se, but not in this combination.

One embodiment of the invention includes a secondary conveying section that is preferably arranged above a main conveying section of the production section.

Another modification of the apparatus according to the invention results in a particularly space-saving embodiment by locating the product buffer in a secondary conveying section, which is arranged above a main conveying section and serves to bypass the main conveying section.

Other advantageous features follow from the dependent claims, the subsequent description, as well as the drawing.

BRIEF DESCRIPTION OF THE DRAWING

The foregoing and other features and advantages of the invention will be apparent from the following description of an exemplary embodiment, as illustrated in the accompanying drawing, wherein the drawing shows:

FIG. 1 illustrates an apparatus for producing selectively collated print products according to one embodiment of the invention.

DETAILED DESCRIPTION OF THE INVENTION

The single Figure shows schematically an apparatus 1 according to an embodiment of the invention, including a production section 3 with a machine frame 16. The production section 3, for example, may be a gathering and wire-stitching machine with an endless conveying element 4. The endless conveying element 4 preferably may be a chain, which is provided with uniformly spaced-apart pushers 5. The conveying element 4 may be operated by a drive 15 and conveys print products 7 in the direction of arrow 8, wherein the print products 7 can be magazines, newspapers., catalogues, or parts thereof. The print products 7 can be wire-stitched or thread-stitched or even perfect bound. After being processed, print products 7 may be provided with an address at a station that is not shown herein (e.g., after the process shown by the Figure), or successively arranged print products 7 are assembled into a package which is then provided with a mail-delivery address.

A transfer-out diverter 10, an intake and centering device 12, a product buffer 13, as well as a transfer-in device 11 are provided in a secondary conveying section B which operates in the manner of a by-pass. The secondary conveying section B is disposed comparatively to the rear of a production line and runs as a type of by-pass above a main conveying section H. For example, the transfer-out diverter 10 may be installed downstream of a cutting device and, if necessary, also downstream of a wire-stitching machine. The transfer-in device 11 is disposed downstream of transfer-out diverter 10 and may be installed upstream of a control means 9 and a labeling device not shown herein. Thus, all critical devices, as well as those subject to malfunctions, are arranged before (upstream of) the transfer-out diverter 10, so that essentially finished print products 7 are present in the region of the transfer-out diverter 10. According to an embodiment of the invention, these essentially finished print products preferably should only need to be provided with an address label and/or stacked.

The transfer-out diverter 10 comprises a diverter 17 which can be displaced between a horizontal position, shown with dashed line, and a slanted position (shown in cross-section). In the slanted position, the print products 2 are diverted from the endless conveying element 4 and conveyed toward the top of secondary section B or by-pass conveying device. Print products 2 may be clamped in between two endless conveying elements 18 and 19 and are transported in upward direction to the intake and centering device 12. If the diverter 17 is in the horizontal position, which may be approximately disposed below endless conveyor element 4, the print products 7 are not picked up by the transfer-out diverter 10 and are transported further in the direction of arrow 8 along endless conveyor element 4 of the main conveying section H. The transfer-out diverter 10 may be used to transfer out so-called "generic books," and/or generic print products 2, which are not selectively collated.

In the intake and centering device 12, the transferred-out print products 2 are centered and supplied to the product buffer 13. The product buffer 13 can accommodate a plurality of generic print products 2 and is provided with a so-called jogger 14, known per se, which supports the stack from the underside along one edge and can be displaced for the withdrawal of print products 2. The print products 2 are withdrawn from the stack bottom and supplied to a transfer-in device 11 which holds the withdrawn print products 2 between two conveying elements 20 and 21 (which may be conveying belts) and transfers them at a discharge opening to the endless conveying element 4 of the main conveying section H. Transfer-in device 11 deposits withdrawn generic print products 2 between two adjacent pushers 5, which do not have a print product 7 inserted between them. That is, the withdrawn print products 2 may be inserted into a gap L between two adjacent pushers 5 where a print product 7 is missing in the production section of print products 7 in the main conveying section H. The transfer-in device 11 may be controlled such that print products 2 are released from belts 20 and 21 with a speed that is synchronized with the speed of the main section H. Of course, a manual feeding is also conceivable in place of the automatic feeding of the product buffer 13.

Secondary conveying section or line B enables gaps L to be automatically refilled with generic print products 2. The generic print products 2 are also produced in the production section 3 before reaching transfer-out diverter 10 and can therefore also be wire-stitched, thread-stitched or perfect-bound products. The generic print products 2 can be transferred out following a signal from the control device S or based on a suitable product characterization, for example a barcode, which is detected by a camera that is not shown herein. Thus, the same devices are used for producing the generic print products 2 as are used for producing the selectively collated print products 7. As a result, the generic print products 2 are identical to print products 7. As described above, the print products transferred out of the production section 3 have not received a mailing label and thus, are not directed toward specific addressees. The print products 2 and 7 are produced in such a way that they are acceptable to all recipients.

The method according to the invention is explained in further detail in the following:

Prior to producing specific products, generic print products 2 are initially produced in production section 3. These generic print products may then be transferred-out with the transfer-out diverter 10 and supplied to the product buffer 13. These transferred-out generic print products 2 are finished products, but have not yet been provided with an address label. In a preferred embodiment, the finished generic print products may be provided with a cover and may be cut to size.

Once the product buffer 13 is filled with generic print products 2, the diverter 17 is moved from the slanted diverting position to the horizontal position and production of the selectively collated print products 7 starts. If no malfunction occurs in the production of print products 7 and no defective or damaged print products 7 should be transferred-out, the secondary conveying section B remains inactive. Consequently, diverter 17 remains in the inactive, horizontal position. On the other hand, if damaged or defective print products 7 are produced, these damaged or defective print products are transferred-out upstream of the transfer-out diverter 10 with the aid of a discharge device 100 (shown schematically in the figure). One of ordinary skill in the art would know the type of discharge devices 100 needed to achieve the desired function. These discharge devices 100 pick up damaged or defective print products 7, while the endless conveying element 4 is running, and convey these damaged or defective print products away from the production line. These discharge devices 100 may convey the damaged print products in an upward/downward direction or toward the side of the production line. As a result of the removal of damaged or defective print products, gaps L exist between un-removed print products in the production section. Such a gap L may be detected and recorded via a detection means 6. Detection means 6 may be installed upstream of the diverter 17. One of ordinary skill in the art would know the type of detection means needed for the present application.

Once detection means 6 detects and records a gap, the control device S issues a signal to the product buffer 13. The issued signal indicates that a generic print should be withdrawn from the product buffer 13. The signal may indicate the required number of generic print products 2 needed to fill in detected gaps L so that jogger 14 supplies the required number of generic print products to the transfer-in device 11. The transfer-in device 11 operates at the same speed as main conveying section H. The transfer-in device 11 then inserts the withdrawn, generic print products 2 into the gaps L, at a speed that is synchronized with the speed of main conveying section H.

Downstream of the transfer-in device 11, the production line is therefore complete again and is checked with the aid of a control means 9. Following the control means 9, the print products 7 and the generic print products 2 may be provided with addresses by an addressing device that is not shown herein. Re-supplying the secondary conveying section with generic print products 2 may not necessary if no production malfunctions occurred and no print products 7 were transferred-out. However, if print products 7 were transferred-out, the missing print products 7 must be replaced with generic print products 2. These generic print products 2 are printed in such a way that they are acceptable to the addressees in place of the selectively collated print products.

If generic print products 2 are withdrawn from the product buffer 13, diverter 17 moves to the slanted diverting position stopping the flow of print products to the main conveying section H and causing the print products to be conveyed to the secondary conveying section B. Thus, additional generic print products 2 are automatically produced in production section 3, are transferred-out with the transfer-out diverter 10 and supplied to the product buffer 13 to restore the number of withdrawn generic print products to print buffer 13. As a result, it is ensured that the product buffer 13 at all times contains print products 2 for refilling gaps L between processed print products 7, if necessary. As previously mentioned, the product buffer 13 can also be filled and/or re-filled manually.

The method according to the invention achieves fully automatic production and route-correct sorting of packages during the "selective binding," even in cases of malfunction.

The secondary conveying section B may have a modular design, wherein a module may be added to a production line, if necessary. A complete integration of the secondary section B with the main conveying section H is conceivable as well.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for producing selectively collated print products, comprising:

processing a plurality of print products in a processing production section;

detecting and removing a defective print product;

conveying non-defective print products in the processing production section toward a main conveying section;

activating a transfer-out diverter and diverting a predetermined number of the non-defective print products out of the processing production section to a secondary conveying section;

supplying the predetermined number of non-defective print products to a product buffer in the secondary conveying section;

deactivating the transfer-out diverter;

detecting and recording a gap between non-defective print products continuing toward the main conveying section, the gap being caused by removal of a defective print product by a discharge device; and inserting a non-defective print product from the product buffer into the detected and recorded gap.

2. The method according to claim 1, wherein the non-defective print product from the product buffer is conveyed with a speed synchronized with the speed of the main conveying section during insertion into the detected and recorded gap.

3. The method according to claim 1, further comprising:

automatically re-supplying the product buffer by diverting a predetermined number of non-defective print products to the product buffer in the secondary conveying section until the product buffer is filled.

4. The method according to claim 1, wherein the print products are one of wire-stitched, thread-stitched, or perfect-bound print products.

5. The method according to claim 4, wherein the print products are one of newspapers, magazines, or catalogues.

6. An apparatus for producing selectively collated print products, said apparatus comprising:

a production section adapted to convey print products in a processing direction;

a discharge device for removing a defective or damaged print product from the production section;

a detection device adapted to detect and record a gap between print products that results from the removal of a defective print product in the production section;

a control device associated with the detection device;

a transfer-out diverter disposed downstream of the production section in the processing direction, the transfer-out diverter capable of moving between a diverting position and an inactive position, wherein when the transfer-out diverter is in the inactive position print products moving in the processing direction are conveyed from the production section to a main conveying section, and wherein when the transfer-out diverter is in the diverting position non-defective print products moving in the processing direction are conveyed from the production section to a secondary conveying line;

a product buffer disposed downstream of the transfer-out diverter in the secondary conveying line, the product buffer arranged to receive print products diverted by the transfer-out diverter and to store the same until signals from the control device indicate that a stored print product be removed; and a transfer-in device disposed downstream of the product buffer, wherein the transfer-in device is adapted to receive print products from the product buffer and to supply the print products from the product buffer to the detected and recorded gaps.

7. The apparatus according to claim 6, wherein the transfer-in device supplies the print products from the product buffer with clocked speed to the detected and recorded gaps.

8. The apparatus according to claim 6, wherein the transfer-in device includes two conveying elements that operate at a speed synchronized with the speed of conveying in the main conveying section.

9. The apparatus according to claim 6, wherein the detection device is arranged upstream of the transfer-out diverter, as seen in the processing direction.

10. The apparatus according to claim 6, wherein the secondary conveying section approximately parallels the main conveying section thereby bypassing the main conveying section.

11. The apparatus according to claim 10, wherein the secondary conveying section is arranged above the main conveying section.

12. The apparatus of claim 10, wherein the secondary conveying section comprises the transfer-out diverter, an intake and centering device, the product buffer and the transfer-in device.

13. The apparatus according to claim 6, wherein the transfer-in device is adapted to supply the print products from the product buffer to the detected and recorded gaps at an end of the main conveying section.

14. The apparatus according to claim 6, wherein at least the product buffer and the transfer-in device are modules capable of being added to the apparatus.

15. The apparatus according to claim 6, wherein the production section comprises one of a gathering and wire-stitching machine or a perfect binder.

16. The apparatus according to claim 6, wherein the print products are one of magazines, newspapers, or catalogues.

17. The apparatus of claim 6, wherein the product buffer has a jogger that supports a stack of print products from the underside along one edge of the product buffer and is displaceable for the withdrawal of print products.

* * * * *